United States Patent [19]

Cole

[11] 4,047,484

[45] Sept. 13, 1977

[54] FUZE WITH BIMETALLIC SPRING DELAY MODULE

[75] Inventor: Lewis C. Cole, Chester, N.J.

[73] Assignee: The United States of America as represented by the Secretary of the Army, Washington, D.C.

[21] Appl. No.: 700,993

[22] Filed: June 29, 1976

[51] Int. Cl.[2] ..... F42C 15/34

[52] U.S. Cl. ..... 102/76 P; 102/70 R

[58] Field of Search ..... 102/76 R, 70 R, 70 S, 102/73 A, 71, 75, 78, 76 P

[56] References Cited

U.S. PATENT DOCUMENTS

| | | | |
|---|---|---|---|
| 2,487,789 | 11/1949 | Carr et al. | 102/70 R |
| 3,702,589 | 11/1972 | Erbert | 102/70 R |
| 3,971,319 | 7/1976 | Larson | 102/70 R X |

*Primary Examiner*—David H. Brown

*Attorney, Agent, or Firm*—Nathan Edelberg; A. Victor Erkkila; Harold H. Card, Jr.

[57] ABSTRACT

A fuze containing a bimetallic spring delay module, which includes a bimetallic Belleville spring and a pyrotechnic charge for heating the spring. The spring is capable of inverting by heat from the pyrotechnic charge and of reverting on cooling, whereby the spring provides a mechanical action by means of an element attached thereto, such as a firing pin, switch, an arming slider or rotor, etc.

2 Claims, 6 Drawing Figures

FUZE WITH BIMETALLIC SPRING DELAY MODULE

GOVERNMENTAL INTEREST

The invention described herein may be manufactured, used and licensed by or for the Government for governmental puposes without the payment to me of any royalty thereon.

BACKGROUND OF THE INVENTION

Various types of fuzes are employed to initiate munitions. Impact fuzes function by actual contact with the target. Delay or time fuzes initiate the munition at some time after launch, drop, emplacement or impact with the target. Such delay fuzes are generally settable at the time of use, and the timing function is provided by means of such devices as clockwork, electronic circuitry and chemical and pyrotechnic reactions. Some munitions are provided with self-destruct capability in addition to the impact or time delay feature to explode the munition in case of target miss or failure of the primary fuze mode.

Plural mode fuzes, i.e. fuzes possessing multiple functioning such as delay arming, impact detonating and self-destruct functioning, generally utilize complex mechanical, electrical and/or chemical activating means. This complexity of design increases the cost as well as the possibility of performance failure of one or more of the many parts of the fuze. Accordingly, a need exists for a simpler, more reliable plural mode fuze for munitions.

SUMMARY OF THE INVENTION

An object of the present invention is to provide a fuze having a bimetallic spring delay module.

Another object of the invention is to provide a fuze of simple design containing a bimetallic spring delay module, which imparts delay arming, impactdetonating functioning or self-destruct functioning of a munition.

A further object of the invention is to provide a munition, e.g. a mine, containing a fuze of simple design possessing a bimetallic spring delay module capable of providing delay arming, impact detonating or self-destruct functioning of the munition.

Other objects will become obvious as the invention is further described.

These and other objects are achieved according to the present invention by means of a fuze comprising a bimetallic spring delay module, which contains a bimetallic spring and a pyrotechnic charge for heating the spring, said spring being capable of inverting from a first stable position to a second stable position by heat from the pyrotechnic charge and of reverting to said first position by cooling, whereby the spring provides a mechanical action by moving an element attached thereto, such as a firing pin, an arming slider or rotor, switch, etc.

The bimetallic spring, such as a Belleville type spring, is constructed of a laminate of dissimilar metals having different coefficients of thermal expansion. Ignition of the pyrotechnic charge heats the bimetallic spring and causes it to invert from the first stable position, wherein the fuze is in an unarmed or safe condition, to the second stable position, wherein the fuze is in an armed condition, which for example permits an integral firing pin to strike and initiate a detonator by reversion (snap-back) of the spring 1) by impact of the fuze on a solid target or 2) by cooling of said spring, thereby causing the munition to self-destruct after a presettable time delay. The delay time is a function of the rate at which the heat generated by the pyrotechnic composition and stored in the bimetallic spring module is dissipated, which in turn depends on such factors as the nature of the bimetallic spring, thermal insulation thereof, nature of the pyrotechnic composition, etc. The delay time can be preset by suitable selection of these factors.

BRIEF DESCRIPTION OF THE DRAWINGS

The foregoing and other objects, features and advantages of the present invention will become apparent from the following specification thereof taken in conjunction with the accompanying drawings in which.

DETAILED DESCRIPTION OF THE INVENTION

Figure 1:
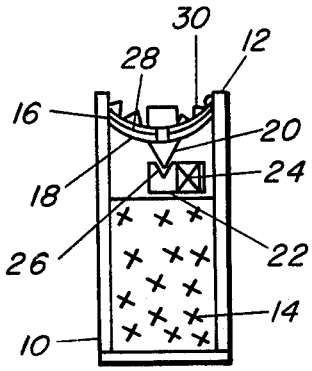
FIG. 1 is a longitudinal section view of a munition embodying a fuze of the present invention containing a bimetallic delay module in the unarmed position.

Referring to FIG. 1, the munition, e.g. a small mine, includes a cylindrical container 10 open at one end 12 and containing a high explosive 14. Fixedly mounted in the open end 12 of container 10 is a bimetallic Belleville spring 16 having an inwardly facing convex surface 18 and provided with an inwardly directed integral firing pin 20. Intermediate the explosive 14 and the firing pin 20 is positioned a safing and arming device comprising a spring biased slider or rotor 22, which contains a detonator 24 for initiating the explosive 14 and a cavity 26 for receiving the point of the firing pin 20 when the fuze is in the unarmed or safe position. The outwardly facing concave surface 28 of the bimetallic spring 16 is coated with a pyrotechnic composition 30.

Figure 2:
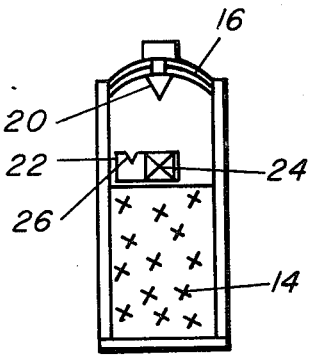
FIG. 2 illustrates the munition of FIG. 1 containing the fuze in the armed position.
Figure 3:
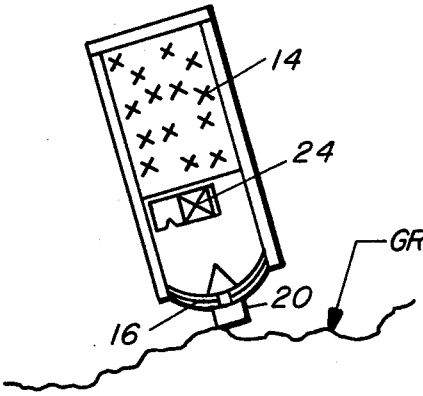
FIG. 3 illustrates the munition of FIG. 1 in point detonating functioning position.
Figure 4:
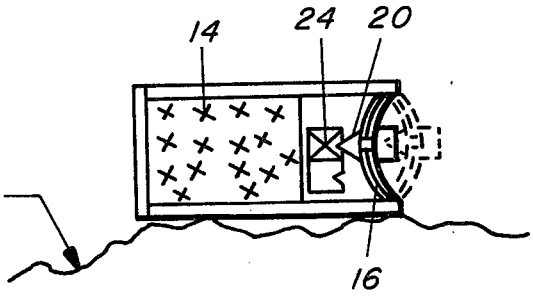
FIG. 4 illustrates the munition of FIG. 1 in self-destruct functioning position.

When the pyrotechnic composition 30 is ignited by suitable ignition means, e.g. electrical, mechanical, flame or other means (not shown), the bimetallic spring 16 is heated, causing it to invert, whereby the firing pin 20 is withdrawn from the cavity 26 and thus permits the spring biased slider or rotor 22 to move to the armed position, wherein the detonator 24 is aligned with the firing pin 20, as illustrated in FIG. 2. When the munition in the armed position strikes the ground with its forward end containing the firing pin 20, as shown in FIG. 3, the impact force pushes back the bimetallic spring 16, causing it to revert or "snap-back" and the firing pin 20 to strike and initiate the detonator 24, which in turn initiates explosive charge 14 (see FIG. 4). If the munition strikes the ground in a way that does not cause the bimetallic spring 16 to revert, the spring will cool and revert (snap-back) automatically after a presettable delay period and impact the firing pin 20 on the detonator 24, thereby causing the munition to self-destruct, as shown in FIG. 4. The bimetallic spring 16 can also be mounted in the container 10 in such a way that it can slide rearward but not forward, so that when the spring is in the inverted position (FIG. 2) it can be pushed rearward on impact without reversion thereof and thus cause the firing pin to strike the detonator 24.

Figure 5:
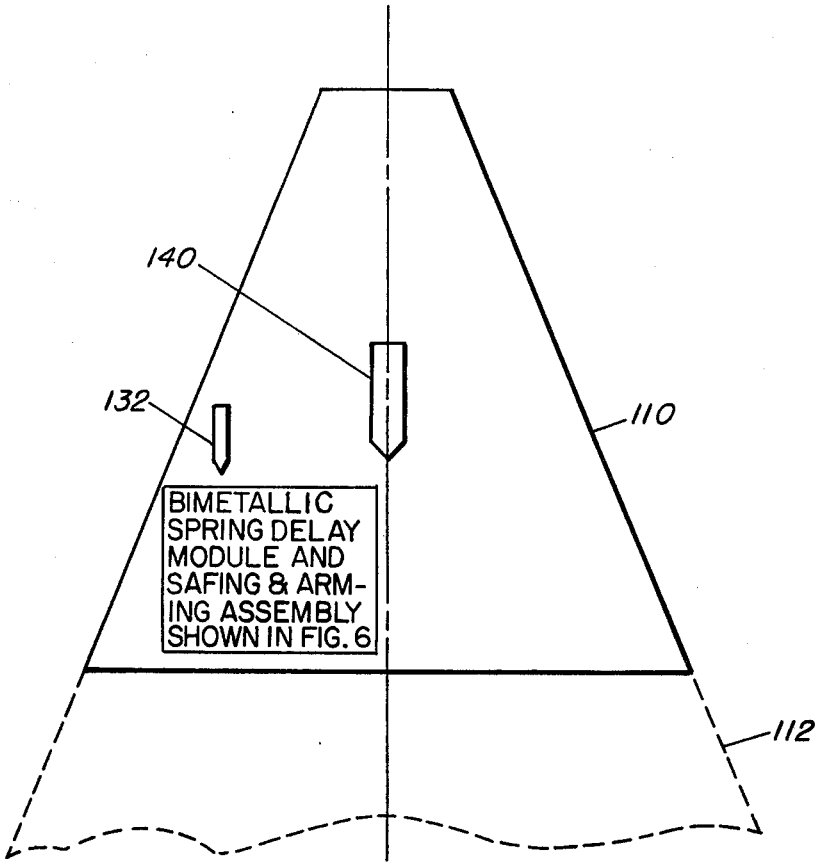
FIG. 5 is an axial cross-sectional view of a fuze for a projectile, e.g. a mortar round, containing a bimetallic spring delay module-safing and arming assembly shown in block diagram.
Figure 6:
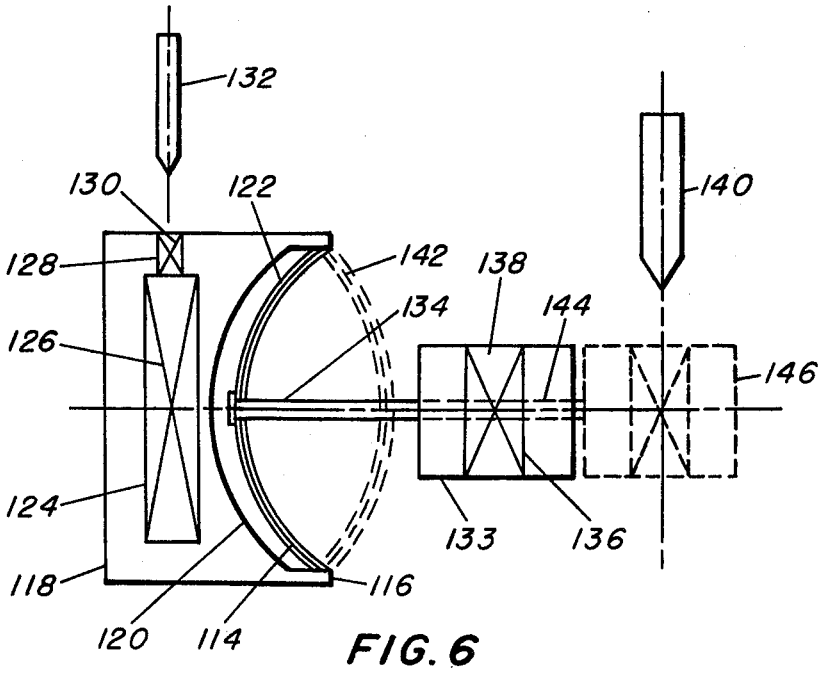
FIG. 6 is a diagrammatic detail view of the bimetallic spring delay module-safing and arming assembly shown in block diagram in FIG. 5.

FIGS. 5 and 6, show an impact fuze 110 for detonating an explosive charge contained in a mortar round 112, partly shown in dotted lines. The fuze 110 contains a fixedly mounted bimetallic delay module comprising a bimetallic Belleville spring 114 peripherally held by a circumferential flange 116 on the end of a cylindrical metallic heat sink 118. The flanged end of the heat sink 118 has a concave recess 120 to accommodate the convex surface 122 of the Belleville spring 114. The heat sink 118 contains a chamber 124 loaded with a pyrotechnic charge 126 and a sidewall bore 128 containing a conventionalstab type primer 130 for initiating the pyrotechnic charge. The bore 128 is aligned with a firing pin 132, which is adapted to strike the primer 130 by setback force. A piston-like slider 133, positioned for movement in a channel not shown, contains a rod 134 which is attached to the center of the Belleville spring 114 by suitable means, e.g. threads or weld. The slider 132 contains a bore 136, which is located with a conventional stab type detonator 138 for initiating the explosive charge contained in the mortar round 112. When the fuze is in a safe or unarmed condition, the detonator 138 is out of alignment with the main firing pin 140, which is driven by impact of the projectile with the earth or other solid target.

When the round is fired from the mortar, setback force drives the firing pin 132 into primer 130, which ignites the pyrotechnic charge 126. Heat from the pyrotechnic charge is transmitted to the heat sink 118 and the bimetallic spring 114. On heating, the bimetallic spring 114 inverts from the first (original) position to the second position shown by the dotted line 142, thereby moving the rod 134 and attached slider 133 to the positions shown by dotted lines 144 and 146 resp., whereby the detonator 138 is aligned with the main firing pin 140 and the fuze is placed in an armed condition.

Thus, for example, the bimetallic delay module can be selected to provide a 2 second arming delay period (required to invert the Belleville spring 114 to the second position after the round is fired from the weapon) and a 2 minute armed period (during which the spring 114 is in the second position 142), wherein the fuze can initiate the detonator 138 and thereby explode the explosive charge contained in the mortar round 112 when the mortar round impacts a solid target. After the expiration of the 2 minute armed period, the bimetallic spring 114 reverts to the first (original) position, wherein the detonator 138 is not aligned with the main firing pin 140. Accordingly, if the mortar round fails to impact the target within the two minute armed period, the fuze will automatically return to the unarmed condition, whereby the round cannot function on impact, and is no longer a safety hazard and can be handled safely.

Besides moving an integral firing pin or an attached slider of a safing and arming mechanism, as illustrated above, the novel bimetallic spring delay module can be utilized in similar manner to provide a mechanical action to operate other mechanical elements attached thereto, such as a switch element to open and close an electrical or mechanical switch of a fuzing device.

The foregoing disclosure and drawings are merely illustrative of the principles of this invention and are not to be interpreted in a limiting sense. I wish it to be understood that I do not desire to be limited to the exact details of construction shown and described, because obvious modification will occur to a person skilled in the art.

I claim:

1. A fuze providing delay arming and impact functioning of a munition, which comprises a bimetallic spring delay module comprising
- a bimetallic spring, and
- a pyrotechnic charge for heating said spring, said spring being capable of inverting from a first stable position to a second stable position by heat from the pyrotechnic charge and of reverting to said first position by cooling, a detonator, a firing pin driven by impact of the fuze with a solid target, and a safing and arming means attached to said bimetallic spring for preventing contact of the firing pin with the detonator when the spring is in said first position, and for permitting contact of the firing pin with the detonator when the spring is in said second position;

whereby ignition of the pyrotechnic charge causes the bimetallic spring to be heated and to invert from said first position, wherein the fuze is in an unarmed condition, to said second position, wherein the fuze is in an armed condition permitting the firing pin to strike the detonator by impact of the fuze on a solid target and the fuze, if not activated by impact while in the armed condition, is returned to the unarmed condition by reversion of said bimetallic spring on cooling.

2. The fuze according to claim 1, wherein the safing and arming means is a slider containing the detonator.

* * * * *